US005822926A

United States Patent [19]

Koike et al.

[11] Patent Number: 5,822,926

[45] Date of Patent: Oct. 20, 1998

[54] STRUCTURE FOR MOUNTING CREMORNE LOCK AND REINFORCING MEMBER IN VERTICAL FRAME ELEMENT CONSTITUTING DOOR OR WINDOW LEAF

[75] Inventors: Sou Koike; Masao Hirano, both of Toyama-ken, Japan

[73] Assignee: YKK Architectural Products Inc., Tokyo, Japan

[21] Appl. No.: 787,007

[22] Filed: Jan. 29, 1997

[30] Foreign Application Priority Data

Feb. 1, 1996 [JP] Japan ..... 8-016468

[51] Int. Cl.[6] ..... E05B 65/06

[52] U.S. Cl. ..... 49/394; 70/451

[58] Field of Search ..... 49/503, 394; 70/417, 70/451, 447, 448

[56] References Cited

U.S. PATENT DOCUMENTS

| | | | |
|---|---|---|---|
| 3,479,851 | 11/1969 | Davidson et al. | 70/451 |
| 3,659,445 | 5/1972 | Eads et al. | 70/451 |
| 3,740,979 | 6/1973 | Crepinsek | 70/139 |
| 3,745,795 | 7/1973 | Sanders | 70/451 |
| 3,888,046 | 6/1975 | Meisterheim . | |
| 4,009,537 | 3/1977 | Hubbard . | |
| 4,204,369 | 5/1980 | Hubbrd . | |
| 4,282,882 | 8/1981 | Langham . | |
| 4,576,023 | 3/1986 | Crepinsek | 70/137 |
| 4,696,174 | 9/1987 | Marks | 70/451 |

*Primary Examiner*—Jerry Redman

*Attorney, Agent, or Firm*—Finnegan, Henderson, Farabow, Garrett & Dunner, L.L.P.

[57] ABSTRACT

An extrusion molded aluminum elongated vertical frame element for constituting a door or window leaf of a hinged door or window comprises first and second vertical plates respectively providing a surface substantively parallel to a door or window face direction and third and fourth vertical plates respectively providing a surface substantively parallel to a door or window thickness direction, thereby having a hollow structure and a substantively rectangular cross section. The fourth vertical plate is provided with an cutout opening. A reinforcing member made of steel, a spacer made of steel and a cremorne lock having a lock body is inserted in the hollow structure of the vertical frame element. The reinforcing member is placed and fixed to the side of the third vertical plate within the hollow structure of the vertical frame element, the spacer is made to abut against the reinforcing member, and the lock body of the cremorne lock is, on one hand, made to abut against the spacer and on the other hand engaged in the cutout opening of the fourth vertical plate. The lock body of the cremorne lock is fixed to the reinforcing member by bolts with the spacer interposed therebetween.

9 Claims, 6 Drawing Sheets

STRUCTURE FOR MOUNTING CREMORNE LOCK AND REINFORCING MEMBER IN VERTICAL FRAME ELEMENT CONSTITUTING DOOR OR WINDOW LEAF

BACKGROUND OF THE INVENTION

The present invention relates to a structure for mounting a cremorne lock and a reinforcing member in a vertical frame element constituting a door or window leaf of a hinged door or window.

A door or window leaf of a hinged door or window is constructed by assembling bilateral vertical frame elements, an upper frame element and a lower frame element to a quadrangular panel mounting frame and mounting a panel such as a glass panel in that quadrangular panel mounting frame. One of the bilateral vertical frame elements of thus constructed door or window leaf is connected by hinges to a vertical frame member constituting a door or window frame, thereby providing a hinged door or window in which a door or window leaf can swing to open and close.

In this kind of hinged door or window, a cremorne lock is mounted in the vertical frame element of the door or window leaf opposite to the hinged vertical frame element, thereby to lock the door or window.

For the vertical frame element constituting the door or window leaf, an extrusion molded aluminum member having a hollow structure is used. Therefore, the vertical frame element is, as it is, liable to be curved and/or deformed when a force is applied thereto in the door or window thickness direction. Therefore, a reinforcing member made of steel is inserted and fixed in the hollow structure of the vertical frame element, thereby to protect the vertical frame element from being curved and/or deformed even when a large force by strong wind is applied thereto in the door or window thickness direction.

When the reinforcing member is inserted and fixed in the hollow structure of the vertical frame element, it is preferable to fix the cremorne lock to the reinforcing member, since in that case, space in the hollow structure of the vertical frame element is effectively utilized and the cremorne lock can be firmly fixed.

The cremorne lock has a lock bolt attached to a lock body in the manner that it can be projected from and retracted into the lock body and a lock rod attached to the lock body in the manner that it can be moved up and down. The lock bolt is fitted in a lock bolt receiver attached to a vertical frame member opposite to the vertical frame element in which the cremorne lock is mounted and constituting the door or window frame, and the lock rod is inserted in a lock hole formed on an upper or lower frame member constituting the door or window frame, thereby to lock the door or window.

Since the cremorne lock has the lock bolt and the lock rod as described above, the cremorne lock needs to be inserted in the hollow structure of the vertical frame element along the longitudinal direction thereof. Further, the cremorne lock needs to be positionally adjusted in the door or window face direction so that the lock bolt may be exactly fitted in the lock bolt receiver.

Since the vertical frame element is an extrusion molded aluminum member, the inner surface of the hollow structure thereof is formed with high precision in dimension and/or figuration. However, the reinforcing member made of steel is formed with lower precision in dimension and/or figuration as compared with the inner surface of the hollow structure of the vertical frame element. For example, the reinforcing member is liable to be formed with a longitudinal curvature.

This causes a positional error of the cremorne lock in the door or window face direction, when the reinforcing member and the cremorne lock are inserted in the hollow structure of the vertical frame element along its longitudinal direction and the cremorne lock is fixed to the reinforcing member. As a result, the lock bolt can not be exactly fitted in the lock bolt receiver.

SUMMARY OF THE INVENTION

An object of the present invention is to provide a structure for mounting a cremorne lock and a reinforcing member in a vertical frame element constituting a door or window leaf of a hinged door or window which can substantially eliminate defects or drawbacks encountered in the prior art described above.

This and other objects can be achieved, according to one aspect of the present invention, by a structure for mounting a cremorne lock and a reinforcing member in a vertical frame element constituting a door or window leaf of a hinged door or window comprising:

an extrusion molded aluminum elongated vertical frame element for constituting a door or window leaf of a hinged door or window, the vertical frame element comprising first and second vertical plates respectively providing a surface substantively parallel to a door or window face direction and third and fourth vertical plates respectively providing a surface substantively parallel to a door or window thickness direction, thereby having a hollow structure and a substantively rectangular cross section, the fourth vertical plate being provided with an cutout opening at its longitudinally intermediate portion;

a reinforcing member made of steel and adapted to be inserted in the hollow structure of the vertical frame element;

a spacer made of steel and adapted to be inserted in the hollow structure of the vertical frame element; and a cremorne lock comprising a lock body adapted to be engaged in the cutout opening of the vertical frame element, wherein the reinforcing member is placed and fixed to the side of the third vertical plate within the hollow structure of the vertical frame element, the spacer is made to abut against the reinforcing member, the lock body is, on one hand, made to abut against the spacer and on the other hand engaged in the cutout opening, and the lock body is fixed to the reinforcing member by means of bolts with the spacer interposed therebetween.

In this structure, since the vertical frame element is reinforced by the reinforcing member and the spacer, the vertical frame element is protected from being curved and/or deformed even when strong wind blows against a door or window leaf.

Further, owing to the arrangement that the lock body of the cremorne lock is fixed to the reinforcing member with the spacer interposed therebetween, the space in the hollow structure of the vertical frame element is utilized effectively, and the lock body of the cremorne lock can be firmly fixed within the hollow structure of the vertical frame element.

Further, owing to the arrangement that the reinforcing member is placed to the side of the third vertical plate apart from the opposite fourth vertical plate having the cutout opening within the hollow structure of the vertical frame element, the reinforcing member made of steel and therefore with low precision in dimension and/or figuration is allowed to be smoothly inserted in the hollow structure of the vertical frame element and reinforce the vertical frame element securely.

Further, in the arrangement that the spacer is made to abut against the reinforcing member, the lock body of the cremorne lock is made to abut against the spacer, and the lock body is fixed to the reinforcing member by means of bolts with the spacer interposed therebetween, it is sufficient if the spacer abuts against the reinforcing member and the lock boy of the cremorne lock only at its longitudinally intermediate portion. Therefore, even when the reinforcing member is formed with low precision in dimension and/or figuration, the lock body of the cremorne lock can be exactly positioned in the door or window face direction within the hollow structure of the vertical frame element and fixed firmly as long as the spacer has an exact dimension in the door or window face direction.

According to another aspect of the present invention, there is provided a structure for mounting a cremorne lock and a reinforcing member in a vertical frame element constituting a door or window leaf of a hinged door or window comprising:

an extrusion molded aluminum elongated vertical frame element for constituting a door or window leaf of a hinged door or window, the vertical frame element comprising first and second vertical plates respectively providing a surface substantively parallel to a door or window face direction and third and fourth vertical plates respectively providing a surface substantively parallel to a door or window thickness direction, thereby having a hollow structure and a substantively rectangular cross section, the fourth vertical plate being provided with an cutout opening at its longitudinally intermediate portion;

an extrusion molded aluminum elongated surrounding member having a hollow structure and adapted to be inserted in the hollow structure of the vertical frame element with its outer surface being in contact with the inner surface of the hollow structure of the vertical frame element;

a reinforcing member made of steel and adapted to be inserted in the hollow structure of the surrounding member; and a cremorne lock comprising a lock body adapted to be engaged in the cutout opening of the vertical frame element, wherein the reinforcing member is inserted in the hollow structure of the surrounding member and held on the inner surface of the hollow structure of the surrounding member, the surrounding member is placed and fixed to the side of the third vertical plate within the hollow structure of the vertical frame element, the lock body is, on one hand, made to abut against the surrounding member and on the other hand engaged in the cutout opening, and the lock body is fixed to the surrounding member by means of bolts.

In this structure, the reinforcing member is held on the inner surface of the hollow structure of the surrounding member, and the surrounding member is fixed within the hollow structure of the vertical frame element. Therefore, the vertical frame element is reinforced by the reinforcing member through the surrounding member.

The vertical frame element and the surrounding member are formed by aluminum extrusion molding, so that the inner surface of the hollow structure of the vertical frame element is formed with high precision in dimension and/or figuration and the surrounding member is formed with high precision in dimension and/or figuration as well. Since the lock body of the cremorne lock is arranged to abut against the surrounding member formed with high precision in dimension and/or figuration which is fixed in the hollow structure of the vertical frame element formed with high precision in dimension and/or figuration, the lock body of the cremorne lock can be exactly positioned in the door or window face direction within the hollow structure of the vertical frame element and fixed firmly.

The nature and further features of the present invention will be made clearer from the following description made with reference to the accompanying drawings.

DESCRIPTION OF THE PREFERRED EMBODIMENTS

Figure 1:
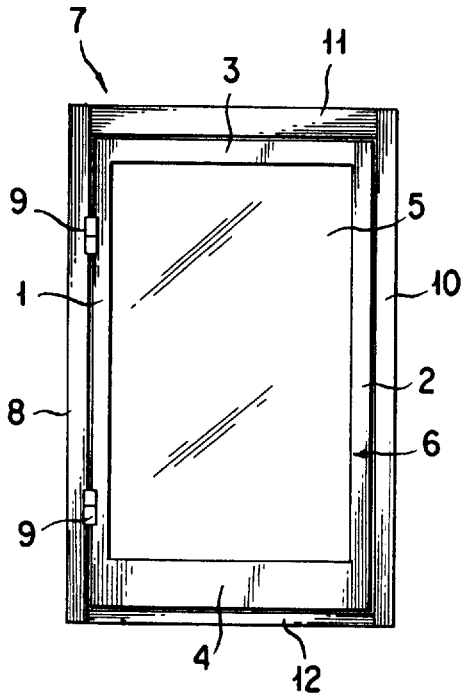
FIG. 1 is an illustrated front view of a hinged door to which the present invention is applicable.

FIG. 1 shows a hinged door to which the present invention is applicable. A first vertical frame element 1, a second vertical frame element 2, an upper frame element 3 and a lower frame element 4 are assembled to a quadrangular panel mounting frame, in which a panel 5 such as a glass panel is mounted, thereby to form a door leaf 6. The first vertical frame element 1 of the door leaf 6 is connected by hinged 9 to a first vertical frame member 8 constituting a door frame 7, thereby to provide a single hinged door in which the door leaf 6 can swing to open and close.

The door frame 7 is composed of a first vertical frame member 8, a second vertical frame member 10, an upper frame member 11 and an lower frame member 12 which are assembled to a quadrangular frame.

It is to be noted that in the following description, terms "first side" and "second side" are correlatively used to indicate the sides corresponding to one and the other of the opposite faces of the door leaf 6, and terms "inside" and "outside" are correlatively used to indicate the side near the center of the door leaf 6 and the side near the circumference of the door leaf 6.

Figure 2:
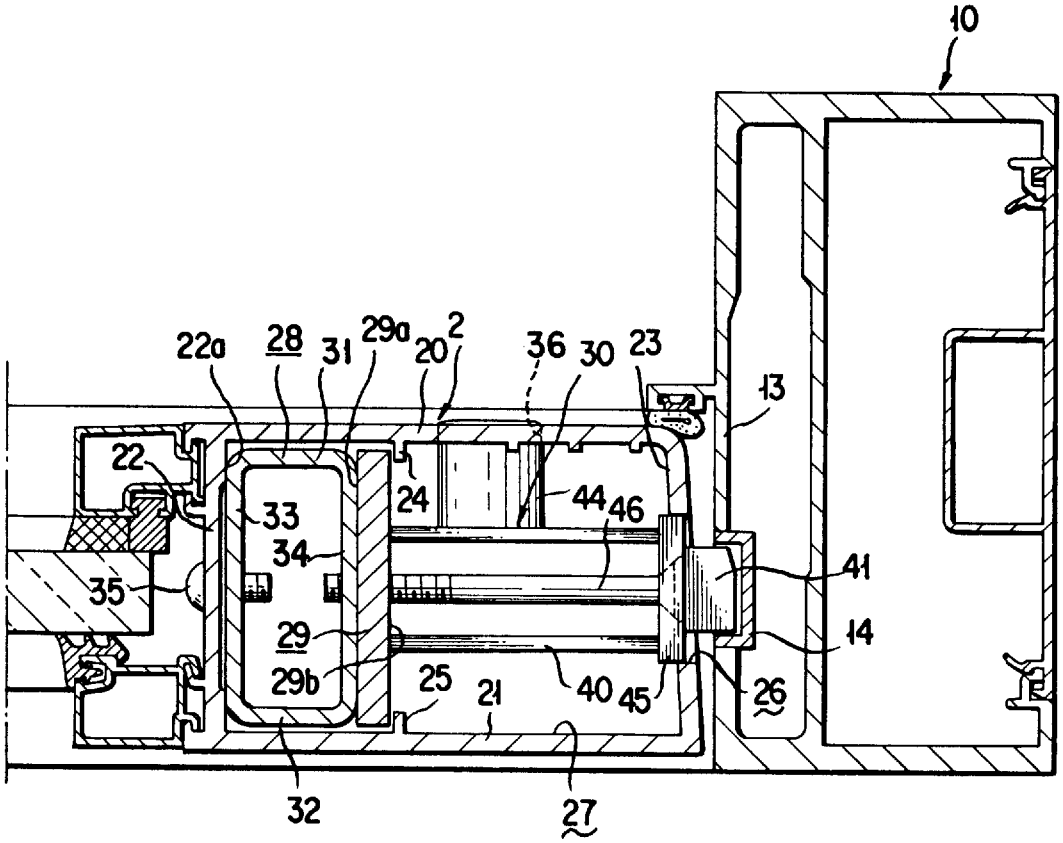
FIG. 2 is a transverse sectional view of a vertical frame member constituting a door frame and a vertical frame element constituting a door leaf showing a first embodiment of the present invention.

The vertical frame element 2 is an extrusion molded aluminum elongated member, and, as shown in FIG. 2, comprises a first side vertical plate 20 and a second side vertical plate 21 respectively providing a surface substantively parallel to the door face direction, and an inside vertical plate 22 and an outside vertical plate 23 respectively providing a surface substantively parallel to the door thickness direction, thereby having a hollow structure 27 and a substantively rectangular cross section. A first side projection 24 is integrally formed on the inner surface of the first side vertical plate 20 at its transversely intermediate portion, while a second side projection 25 is integrally formed on the inner surface of the second side vertical plate 21 at its transversely intermediate portion. The first side projection 24 and the second side projection 25 are opposite to each other.

A cutout opening 26 is formed in the outside vertical plate 23 of the vertical frame element 2 at its longitudinally intermediate portion. A reinforcing member 28 and a spacer 29 are inserted in the hollow structure 27 of the vertical frame element 2 between the inside vertical plate 22 and the projections 24 and 25. A cremorne lock 30 is mounted in the hollow structure 27 of the vertical frame element 2 to the side of the outside vertical plate 23.

The reinforcing member 28 is made of steel and comprises a first side plate 31 and a second side plate 32 respectively placed parallel to the door face direction, and an inside plate 33 and an outside plate 34 respectively placed parallel to the door thickness direction, thereby having a hollow structure and a substantively rectangular cross section.

A dimension between the first side and second side plates 31 and 32 of the reinforcing member 28 is smaller than the inner width of the hollow structure 27 of the vertical frame element 2 (a dimension between the inner surfaces of the first side and second side vertical plate 20 and 21), and a dimension between the inside and outside plates 33 and 34 is considerably smaller than a distance between the inner surface of the inside vertical plate 22 and the projections 24 and 25. Therefore, the reinforcing member 28 can be smoothly inserted in the hollow structure 27 of the vertical frame element 2 along its longitudinal direction even if the reinforcing member 28 is longitudinally curved.

The reinforcing member 28 is fixed within the hollow structure 27 of the vertical frame element 2 by securing the inside plate 33 to the inner surface 22*a* of the inside vertical plate 22 by a plurality of screws 35. The screws 35 are driven from the side of the inside vertical plate 22 of the vertical frame element 2 into the inside plate 33 of the reinforcing member 28, and that longitudinally spaced apart from each other. The inside vertical plate 22 of the vertical frame element 2 is so formed that its bilateral end portions have a thickness thicker than its intermediate portion, so that the inside plate 33 of the reinforcing member 28 is pressed on the bilateral thicker end portions of the inside vertical plate 22. Rivets may be used in place of the screws 35.

The spacer 29 is a plate-like member and made of steel. The spacer 29 is so arranged that one of its faces 29*a* is in contact with the outside plate 34 of the reinforcing member 28 and the other face 29*b* faces the projections 24 and 25.

Figure 3:
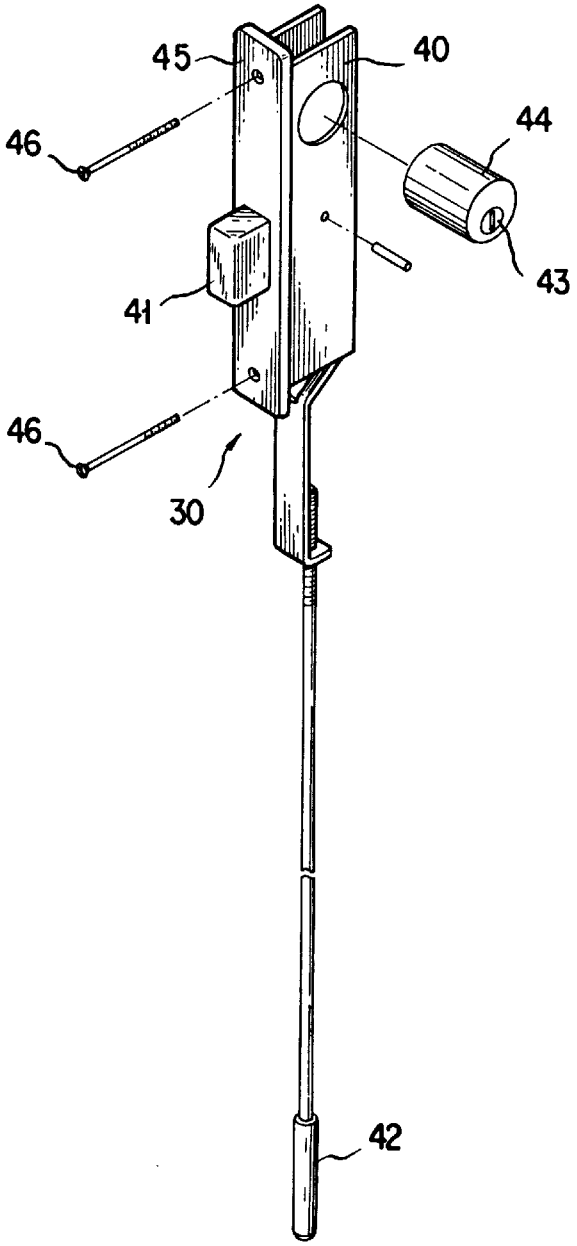
FIG. 3 is a perspective view of a cremorne lock.

As shown in FIG. 3, the cremorne lock 30 comprises a lock body 40, a lock bolt 41 attached to the lock body 40 in the manner that it can be projected from and retracted into the lock body 40, a lock rod 42 attached to the lock body 40 in the manner that it can be moved up and down and a rotational member 44 inserted in the lock body 40 and provided with a key hole 43. The lock bolt 41 is projected and retracted and the lock rod 42 is moved up down by rotating the rotational member 44 by use of a key which is to be inserted in the key hole 43. The cremorne lock 30 is in itself known, therefore, detailed description thereof is omitted herein.

The cremorne lock 30 is inserted in the hollow structure 27 of the vertical frame element 2 along its longitudinal direction, and a front flange portion 45 of the lock body 40 is fitted in the cutout opening 26. An elongated bolt 46 is driven from the front flange portion 45 through the spacer 29 and the outside plate 34 of the reinforcing member 28, thereby to secure the lock body 40 to the reinforcing member 28 with the spacer 29 interposed therebetween.

After the lock body 40 of the cremorne lock 30 is mounted in the hollow structure 27 of the vertical frame element 2 as described above, the rotational member 44 is inserted through a hole 36 formed in the first side vertical plate 20 of the vertical frame element 2 to be mounted in the lock body 40.

A lock bolt receiving member 14 is attached to a plate 13 opposite to the second vertical frame element 2 and constituting the second vertical frame member 10 of the door frame 7. The lock bolt 41 is fitted in the lock bolt receiving member 14 and the lock rod 42 is fitted in a hole formed at the lower frame member 12 of the door frame 7, thereby to lock the door. A cremorne lock 30 may have both an upward lock rod and a downward lock rod.

The reinforcing member 28, the spacer 29 and the cremorne lock 30 are mounted in the hollow structure 27 of the vertical frame element 2 in the following order.

First, the cremorne lock 30 is inserted in the hollow structure 27 of the vertical frame element 2 along the longitudinal direction thereof, and the lock body 40 is positionally adjusted to the cutout opening 26 of the outside vertical plate 23 of the vertical frame element 2.

The cremorne lock 30 is then moved to the outside so that the front flange portion 45 of the lock body 40 is fitted in the cutout opening 26 of the outside vertical plate 23 and thus temporarily attached thereto.

Next, the reinforcing member 28 is inserted in the hollow structure 27 of the vertical frame element 2 along its longitudinal direction and secured to the inside vertical plate 22 of the vertical frame element 2 by screws 35.

Next, the spacer 29 is inserted in the space surrounded by the outside plate 34 of the reinforcing member 28 and the projections 24 and 25 along its longitudinal direction. Then, the bolt 46 is driven from the front flange portion 45 of the lock body 40 of the cremorne lock 30 through the spacer 29 and the outside plate 34 of the reinforcing member 28, thereby to fix the lock body 40.

Thus, in this structure, the reinforcing member 28 made of steel and therefore with low precision in dimension and/or figuration can be inserted in the hollow structure 27 of the vertical frame element 2 along its longitudinal direction and fixed firmly, and the lock body 40 of the cremorne lock 30 can be firmly secured to this reinforcing member 28 by the bolt 46 with the spacer 29 interposed therebetween.

The spacer 29 is made of steel and therefore with low precision in dimension and/or figuration. However, it is sufficient if the spacer 29 abuts against the reinforcing member 28 and the lock body 40 of the cremorne lock 30 only at its longitudinally intermediate portion. Therefore, as long as the spacer 29 has an exact thickness (an exact dimension along the door face direction), the lock body 40 of cremorne lock 30 can be exactly positioned in the door face direction and fixed firmly.

Further, since the spacer 29 is so arranged that the outside face 29*b* is opposite to the projections 24 and 25, the space 29 is stopped by the projections 24 and 25 from moving to the outside when the bolt 46 is driven to secure the lock body 40 of the cremorne lock 30. This is also helpful in positioning and securing firmly the body 40 of cremorne lock 30.

Figure 4:
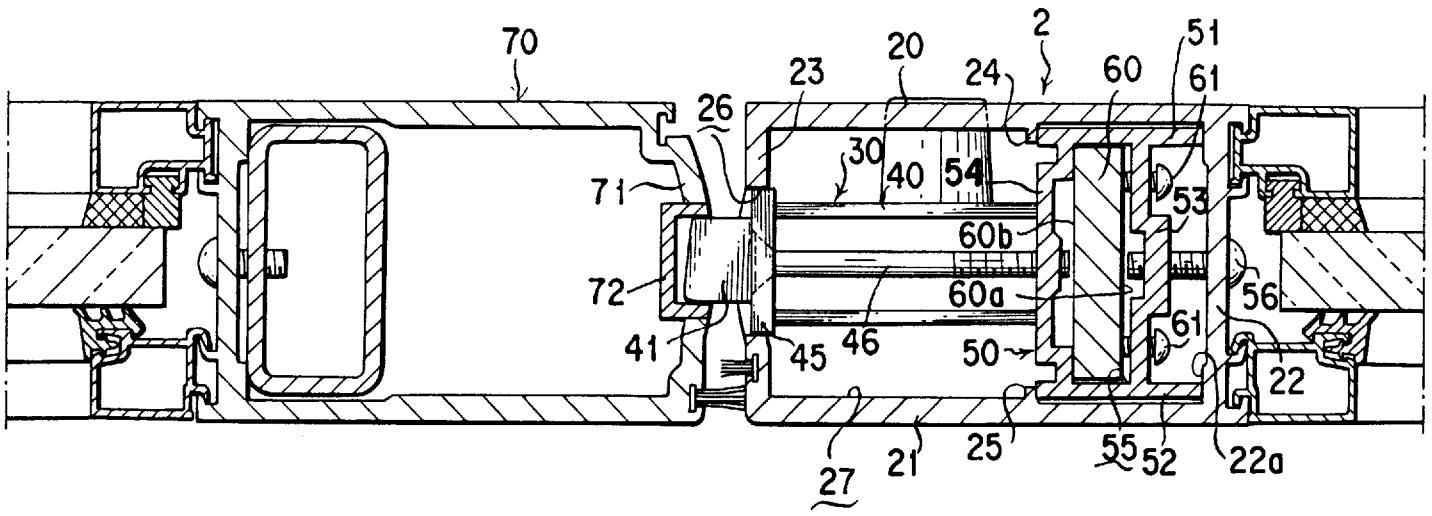
FIG. 4 is a transverse sectional view of a vertical frame member constituting a door frame and a vertical frame element constituting a door leaf showing a second embodiment of the present invention.

FIG. 4 shows a second embodiment of the present invention, in which the same reference numerals are used for members and elements corresponding to those of the first embodiment mentioned above.

A member 50 for surrounding a reinforcing member 60 is fitted in the hollow structure 27 of the vertical frame element 2 between the inside vertical plate 22 and the projections 24 and 25. The surrounding member 50 is an extrusion molded aluminum elongate member and comprises a first side plate 51 and a second side plate 52 respectively placed parallel to the door face direction, and an inside plate 53 and an outside plate 54 respectively placed parallel to the door thickness direction, thereby having a hollow structure 55 and a substantively rectangular cross section. Since the surrounding member 50 is formed by aluminum extrusion molding, the surrounding member 50 has high precision in dimension and/or figuration.

The surrounding member 50 is fitted in the hollow structure 27 with the first side plate 51 abutting against the inner surface 22*a* of the inside vertical plate 22 and the first side projection 24 and with the second side plate 52 abutting against the inner surface 22*a* of the inside vertical plate 22 and the second side projection 25, Further, screws 56 are driven from the inside vertical plate 22 into the inside plate 53 of the surrounding member 50, thereby to fix the surrounding member 50 in the hollow structure 27 of the vertical frame element 2 firmly.

A plate-like reinforcing member 60 made of steel is inserted in the hollow structure 55 of the surrounding member 50 along its longitudinal direction.

The reinforcing member 60 has a thickness (a dimension along the door face direction) smaller a dimension between the inner surfaces of the inside and outside plates 53 and 54 of the surrounding member 50.

The screws 61 are driven from bilateral end portions of the inside plate 54 of the surrounding member 50 so as to be pressed against the inside face 60*a* of the reinforcing member 60. Thereby, the outside face 60*b* of the reinforcing member 60 is pressed on the bilateral end portions of the outside plate 54 of the surrounding member 50, thereby the reinforcing member 60 is held on the inner surface of the hollow structure 55 of the surrounding member 50. The reinforcing member 60 may be held on the inner surface of the hollow structure 55 of the surrounding member 50 by inserting spacers such as wedge members between the inner surface of the hollow structure 55 and the reinforcing member 60, instead of using the screws 61.

In this structure, the vertical frame element 2 is reinforced by the reinforcing member 60 through the surrounding member 50.

The lock body 40 of the cremorne lock 30 is mounted in the hollow structure 27 of the vertical frame element 2 to the side of the outside vertical plate 23 in the same manner as described with respect to the first embodiment. The bolt 46 is driven from the front flange portion 45 of the lock body 40 into the outside plate 54 of the surrounding member 50.

The surrounding member 50, the reinforcing member 60 and the cremorne lock 30 are mounted in the following order.

Figure 5:
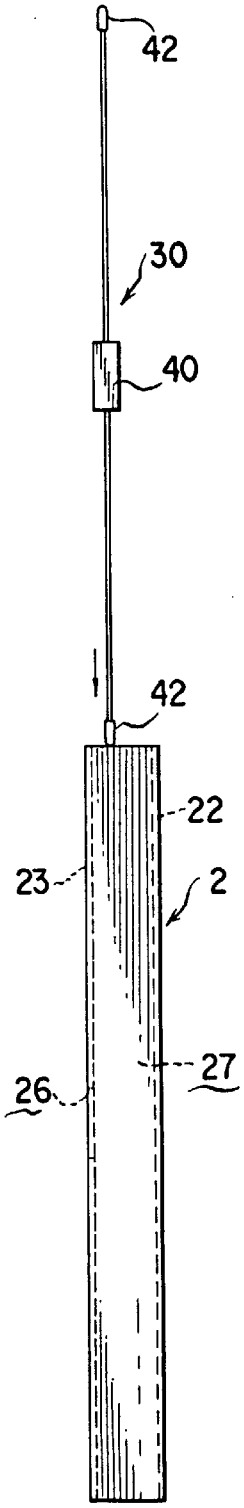
FIG. 5 is a view showing how the cremorne lock is inserted in a hollow structure of the vertical frame element.

First, as shown in FIG. 5, the cremorne lock 30 is inserted in the hollow structure 27 of the vertical frame element 2 along its longitudinal direction. Then, the cremorne lock 30 is moved to the outside as indicated by an arrow A in FIG. 6 so that the front flange portion 45 of the lock body 40 is fitted in the cutout opening 26 formed in the outside vertical plate 23 of the vertical frame element 2 and thus temporarily attached thereto.

Next, the reinforcing member 60 is inserted in the hollow structure 55 of the surrounding member 50 along its longitudinal direction, and the screws 61 are driven to hold the reinforcing member 60 on the inner surface of the hollow structure 55.

Figure 6:
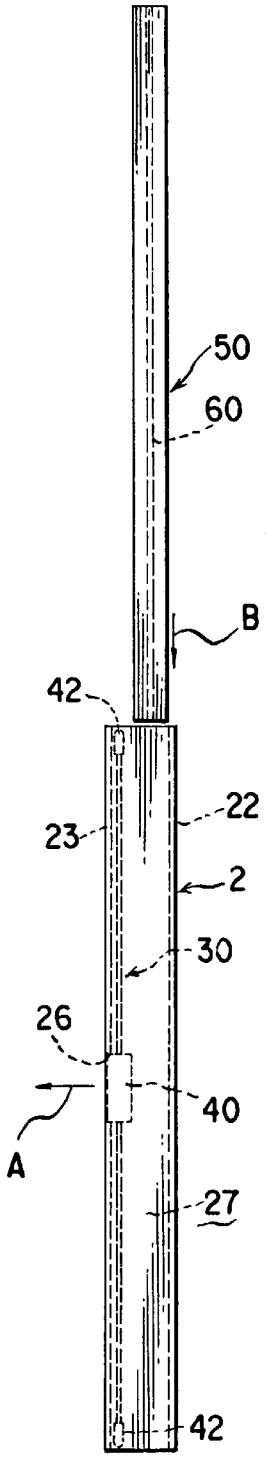
FIG. 6 is a view showing how the cremorne lock and a surrounding member are inserted in a hollow structure of the vertical frame element.

Then, the surrounding member 50 holding the reinforcing member 60 therein is inserted in the hollow structure 27 of the vertical frame element 2 along its longitudinal direction as indicated by an arrow B in FIG. 6. Then, the bolt 46 is driven from the front flange portion 45 of the lock body 40 into the outside plate 54 of the surrounding member 50 as shown in FIG. 4, thereby to fix the lock body 40.

In FIG. 4, the lock bolt 41 attached to the lock body 40 of the cremorne lock 30 is fitted in a lock bolt receiving member 72 attached to a vertical plate 71 opposite to the vertical frame element 2 and constituting a vertical frame element 70 of another door leaf. That is, the embodiment shown in FIG. 4 is the case where the present invention is applied to a double hinged door in which two door leaves can swing to open and close.

It is to be noted that the present invention is not limited to the described embodiments and many other changes and modifications may be made without departing from the scopes of the appended claims.

What is claimed is:

1. A structure comprising:

an extrusion molded aluminum elongated vertical frame element housing first and second vertical plates, each having a surface substantially parallel to a face direction of said structure and third and fourth vertical plates, each having a side and a surface substantially parallel to a thickness direction of said structure, thereby providing a hollow structure with a substantially rectangular cross section, said fourth vertical plate further having a cutout opening at a longitudinally intermediate portion of said fourth vertical plate;

a reinforcing member made of steel and adapted to be inserted in said hollow structure of said vertical frame element;

a spacer made of steel and adapted to be inserted in the hollow structure of said vertical frame element; and a cremorne lock comprising a lock body adapted to be engaged in the cutout opening of said vertical frame element, wherein said reinforcing member is placed and fixed to the side of said third vertical plate within said hollow structure of said vertical frame element, said spacer is made to abut against said reinforcing member, said lock body is, on one hand, made to abut against said spacer and on the other hand engaged in said cutout opening, and said lock body is fixed to said reinforcing member by means of bolts with said spacer interposed therebetween; and wherein said first and second vertical plates are each provided with a projection in the manner that the projection of said first vertical plate is opposite to the projection of said second vertical plate within said hollow structure, and said reinforcing member and said spacer are inserted between said third vertical plate and said projections.

2. A structure according to claim 1, wherein said reinforcing member is fixed in said hollow structure of said vertical frame element by securing said third plate of said reinforcing member to said third vertical plate of said vertical frame element by a plurality of screws driven from said third vertical plate to said vertical plate.

3. A structure according to claim 2, wherein said third vertical plate of said vertical frame element is so formed that its bilateral end portions have a thickness thicker than its intermediate portion so that said third plate of said reinforcing member is pressed on said bilateral thicker end portions of said third vertical plate when said third plate is secured to said vertical plate.

4. A structure according to claim 1, wherein said spacer is a plate-like member and so arranged that one face thereof is in contact with said reinforcing member and the other face thereof faces said projections.

5. A structure comprising:

an extrusion molded aluminum elongated vertical frame element having first and second vertical plates, each having a surface substantially parallel to a face direction of said structure and third and fourth vertical plates, each having a side and a surface substantially parallel to a thickness direction of said structure, thereby providing a hollow structure having an inner surface and a substantially rectangular cross section, said fourth vertical plate further having a cutout opening at a longitudinally intermediate portion of said fourth vertical plate;

an extrusion molded aluminum elongated surrounding member having a hollow structure and adapted to be inserted in said hollow structure of said vertical frame element with its outer surface being in contact with the inner surface of said hollow structure of said vertical frame element;

a reinforcing member made of steel and adapted to be inserted in said hollow structure of said surrounding member; and a cremorne lock comprising a lock body adapted to be engaged in said cutout opening of said vertical frame element, wherein said reinforcing member is inserted in said hollow structure of said surrounding member and held on the inner surface of said hollow structure of said surrounding member, said surrounding member is placed and fixed to the side of said third vertical plate within said hollow structure of said vertical frame element, said lock body is, on one hand, made to abut against said surrounding member and on the other hand engaged in said cutout opening, and said lock body is fixed to said surrounding member by means of bolts; and wherein said first and second vertical plates are each provided with a projection in the manner that the projection of said first vertical plate is opposite to the projection of said second vertical plate within said hollow structure, and said surrounding member is fitted between said third vertical plate and said projections.

6. A structure according to claim 5, wherein said surrounding member comprises first and second plates respectively placed parallel to a door face direction and third and fourth plates respectively placed parallel to a door thickness direction, thereby having said hollow structure and a substantially rectangular cross section.

7. A structure according to claim 6, wherein said surrounding member is fitted in said hollow structure of said vertical frame element with said first plate abutting against the inner surface of said third vertical plate and said projection of said first vertical plate and with said second plate abutting against said inner surface of said third vertical plate and said projections of said second vertical plate.

8. A structure according to claim 7, wherein said surrounding member is fixed in said hollow structure of said vertical frame element by securing said third plate of said surrounding member to said third vertical plate of said vertical frame element by a plurality of screws driven from said third vertical plate to said third plate.

9. A structure according to claim 5, wherein said reinforcing member is a plate-like member and held on the inner surface of said hollow structure of said surrounding member by being pressed on said fourth plate of said surrounding member by screws driven from said third plate of said surrounding member.

* * * * *